US005370963A

United States Patent [19]

Patel et al.

[11] Patent Number: 5,370,963

[45] Date of Patent: Dec. 6, 1994

[54] TONER EMULSION AGGREGATION PROCESSES

[75] Inventors: Raj D. Patel, Oakville; Grazyna E. Kmiecik-Lawrynowicz, Burlington; Michael A. Hopper, Toronto, all of Canada

[73] Assignee: Xerox Corporation, Stamford, Conn.

[21] Appl. No.: 82,651

[22] Filed: Jun. 25, 1993

[51] Int. Cl.[5] ..... G03G 9/08

[52] U.S. Cl. ..... 430/137; 430/106

[58] Field of Search ..... 430/106, 110, 137

[56] References Cited

U.S. PATENT DOCUMENTS

| | | | |
|---|---|---|---|
| 4,137,188 | 1/1979 | Uetake et al. | 252/62.1 P |
| 4,558,108 | 12/1985 | Alexandru et al. | 526/340 |
| 4,797,339 | 1/1989 | Maruyama et al. | 430/109 |
| 4,912,009 | 3/1990 | Amering et al. | 430/110 |
| 4,983,488 | 1/1991 | Tan et al. | 430/137 |
| 4,996,127 | 2/1991 | Hasegawa et al. | 430/109 |
| 5,262,269 | 11/1993 | Nair et al. | 430/110 |

*Primary Examiner*—John Goodrow
*Attorney, Agent, or Firm*—E. O. Palazzo

[57] ABSTRACT

A process for the preparation of toner compositions with controlled particle size comprising:

(i) preparing a pigment dispersion in water, which dispersion is comprised of pigment, an ionic surfactant, and an optional charge control agent;

(ii) shearing at high speeds the pigment dispersion with a polymeric latex comprised of resin, a counterionic surfactant with a charge polarity of opposite sign to that of said ionic surfactant and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bounded toner size aggregates with a narrow particle size distribution;

(iv) heating the statically bound aggregated particles above about the Tg of the resin particles to provide coalesced toner comprised of resin, pigment, and optional charge control agent, and subsequently optionally accomplishing (v) and (vi);

(v) separating said toner; and (vi) drying said toner.

40 Claims, No Drawings

TONER EMULSION AGGREGATION PROCESSES

BACKGROUND OF THE INVENTION

The present invention is generally directed to toner processes, and more specifically to aggregation and coalescence processes for the preparation of toner compositions. In embodiments, the present invention is directed to the economical preparation of toners without utilization of the known pulverization and/or classification methods, and wherein toner compositions with an average volume diameter of from about 1 to about 25, and preferably from 1 to about 10 and more preferably from about 3 to about 7 microns in average volume, and narrow GSD of, for example, from about 1.16 to about 1.26 as measured on the Coulter Counter, can be obtained. The resulting toners can be selected for known electrophotographic imaging and printing processes, including color processes, and lithography. In embodiments, the present invention is directed to a process comprised of dispersing a pigment and optionally a charge control agent or additive in an aqueous mixture containing an ionic surfactant in amount of from about 0.01 percent (weight percent throughout unless otherwise indicated) to about 10 percent and shearing this mixture at high speeds, for example, in the range of about 3,000 to about 15,000 rpm (revolutions per minute) and preferably in the range of about 6,000 to about 12,000 rpm with a latex mixture comprised of suspended resin particles of from, for example, about 0.01 micron to about 1 micron in volume average diameter, in an aqueous solution containing a counterionic surfactant in amounts of from about 0.01 percent to about 10 percent with opposite charge to the ionic surfactant of the pigment dispersion, and nonionic surfactant in amount of from 0 percent to about 5 percent, thereby causing a flocculation of resin particles, pigment particles and optional charge control particles, followed by heating about 5° C. to about 35° C. and preferably about 5° C. to about 20° C. below the resin Tg, which range is generally between about 40° C. to about 80° C. and preferably in the range of about 50° C. to about 75° C. to form statically bound aggregates of from about 1 micron to about 10 microns in volume average diameter comprised of resin, pigment and optional charge control components. The flocculation or the heterocoagulation of the pigment particles containing ionic surfactant in amounts of about 0.01 percent to 10 percent and preferably between 0.1 percent to 5 percent with the latex mixture comprised of submicron resin particles containing the counterionic surfactant in the amounts of 0.01 percent to 10 percent and preferably between 0.1 percent to 5 percent causes a significant increase in the viscosity of the system, an increase, for example, of from about 4 centipoise to about 3,000 centipoise, resulting in big clusters or flocculants. Without the breakdown of these clusters or flocculants, a noncontrolled aggregation in step (iii) can be obtained in embodiments resulting in particle size and GSD of unacceptable or undesirable values. By applying a high shear of, for example, about 3,000 to about 15,000 rpm and preferably between about 5,000 and 12,000 rpm at the step (ii) stage, a homogeneous or a uniform blend is obtained whereby the big clusters or flocculants are broken or reduced to about submicron size, for example about 0.05 to about 1 micron, followed by heating to from about 40° C. to about 5° C. and preferably about 25° C. to about 5° C. below the resin Tg, which is generally in the range of about 40° C. to about 80° C. and preferably between about 50° C. to about 75° C. to form the statically bonded aggregates of step (iii). The aforementioned increase in viscosity, an increase of, for example, from about 2 centipoise to about 2,000 centipoise is primarily a result of the combination of pigment particles containing ionic surfactant with the latex mixture comprised of submicron resin particles containing the counterionic surfactant coming together (charge neutralization), and also a function of the solids of resin, pigment and optional charge control additives, or volume fraction loading in step (ii), for example at 20 percent loading the viscosity can be as high as 10,000 centipoise. The zeta potential of the latex prepared by emulsion polymerization containing resin in the anionic/nonionic surfactant can also be another factor, for example a latex measured zeta potential of about −100 millivolts can require a larger quantity of the counterionic surfactant to that of the said ionic surfactant in the latex for charge neutralization and hence flocculation to occur. Also, the amounts of the ionic to counterionic surfactants employed independent of the solids loading or the zeta potential of the latex can lead to an increase of viscosity, for example with a 2:1 molar ratio of cationic to anionic surfactant increases the viscosity of the blend increases to from about 2 to about 3,000 centipoise. These and other factors, especially the solids loading, the high zeta potential of the latex, and the molar ratios of the ionic to counterionic surfactant can result in an increase in viscosity, for example from about 2,000 to about 8,000 centipoise. High shear devices, such as a polytron, a homogenizer, a continuous IKA shearing device or a Dispax-reactor and the like thereof, are substantially unable to effectively process high viscosity mixtures and break down the huge clusters or flocculants formed. Therefore, the viscosity can increase to such an extent that the shearing power of the aforementioned equipment is rendered uneffective as it is not able to break down the huge clusters, resulting in an uncontrolled aggregation (step iii) and providing unacceptable particle size distribution, GSD, in the range of 1.85 to 3.5.

In another embodiment thereof, the present invention is directed to an in situ process comprised of first dispersing a pigment, such as HELIOGEN BLUE TM or HOSTAPERM PINK TM, in an aqueous mixture containing a cationic surfactant, such as benzalkonium chloride (SANIZOL B-50 TM), utilizing a high shearing device, such as a Brinkmann Polytron, microfluidizer or sonicator, thereafter shearing at high speeds in the range of 30,00 to 15,000 rpm and preferably between 5,000 and 12,000 rpm this mixture with a latex of suspended resin particles, such as poly(styrene butadiene acrylic acid), poly(styrene butyl acrylate acrylic acid) or PLIOTONE TM, a poly(styrene butadiene), and which particles are, for example, of a size ranging from about 0.01 to about 0.5 micron in volume average diameter as measured by the Brookhaven nanosizer in an aqueous surfactant mixture containing an anionic surfactant, such as sodium dodecylbenzene sulfonate (for example NEOGEN R TM or NEOGEN SC TM) and nonionic surfactant, such as alkyl phenoxy poly(ethylenoxy) ethanol (for example IGEPAL 897 TM or ANTAROX 897 TM), thereby resulting in a flocculation, or heterocoagulation of the resin particles with the pigment particles; and wherein the resulting flocculated mixture is pumped through the shearing chamber, or zone at very high speeds generally in the range of 3,000 to 15,000 and preferably between 5,000 to 12,000 rpm, and is continuously recirculated for about 1 to about 120 minutes while being stirred at 200 rpm in a holding tank. This shearing can generally consume from about 1 minute to about 120 minutes to achieve a homogeneous or a uniform blend with a consistency of whip cream as contrasted to a cottage cheese consistency. The blend comprises very small, submicron in size, clusters of resins, and optional charge control agents, which are then allowed to grow by heating the mixture from about 5° C. to about 25° C. below the resin Tg, which resin Tg is preferably equal to 54° C. and generally is in the range of about 40° C. to about 80° C. and preferably in the range of about 50° C. to about 75° C., and increase the speed, up to 10 times quicker, of the growth of the aggregates in a controlled manner while stirring at a speed of about 300 to about 800 rpm. This results in the formation of statically bound aggregates ranging in size of from about 0.5 micron to about 10 microns in average volume diameter size as measured by the Coulter Counter (Multisizer II). Extra anionic or nonionic surfactant, in an amount of about 0.5 to 5 percent by weight of water, can be added to the mixture to stabilize the aggregates formed. Thereafter, heating from about 5° C. to about 50° C. above the resin Tg, which resin Tg is in range of from about 50° C. to about 75° C. is accomplished to provide for particle fusion or coalescence of the polymer, or resin and pigment particles; followed by washing with, for example, hot water to, for example, remove surfactants; and drying whereby toner particles comprised of resin and pigment with various particle size diameters can be obtained, such as from 1 to 12 microns in average volume particle diameter. The aforementioned toners are especially useful for the development of colored images with excellent line and solid resolution, and wherein substantially no background deposits are present. While not being desired to be limited by theory, it is believed that the flocculation or heterocoagulation is caused by the neutralization of the pigment mixture containing the pigment and cationic surfactant absorbed on the pigment surface, with the resin mixture containing the resin particles, and anionic surfactant absorbed on the resin particle. This can be considered a kinetically controlled process. Furthermore, in other embodiments the ionic surfactants can be exchanged, such that the pigment mixture contains pigment and anionic surfactant, and the suspended resin mixture contains the resin particles and cationic surfactant; followed by the ensuing steps as illustrated herein to enable flocculation by charge neutralization while shearing at high speed, generally in the range of about 3,000 to about 15,000 rpm and preferably in the range of 3,000 to 12,000 rpm, to ensure a uniform or a homogeneous mixture comprising small, submicron to 1 micron size, clusters or flocks, and thereby forming statically bounded or attached aggregate particles by stirring and heating at about 5° C. to about 25° C. below the resin Tg, which resin Tg is in the range of about 40° C. to about 80° C. and preferably between 50° C. and 75° C., and thereafter, heating the statically bound aggregates from about 5° C. to about 50° C. above the resin Tg at temperatures of from about 60° C. to about 100° C. to form stable toner compositions. Of importance with respect to the processes of the present invention in embodiments is the utilization of high speed shearing devices, such as rotator(s)–stator(s), for example polytrons, homogenizers, megatrons, disintegrators, high efficiency dispensers, and the like in step (ii) as illustrated herein to achieve a narrow particle size distribution which generally is in the range of 1.18 to 1.27 upon aggregating (step iii) the particles by stirring from about 200 to about 800 rpm, and heating at about 5° C. to about 25° C. below the resin Tg which is in the range of about 40° C. to about 80° C. and preferably between 50° C. to 75° C.; (iv) adding extra anionic surfactant or nonionic surfactant from about 0.5 to about 5 weight percent of water to stabilize the aggregates of (iii), heating about 5° C. to about 50° C. above the resin Tg (step v) to form stable toner composite particles comprising resin, pigment particles, and optional charge control agent. Without the use of the aforementioned high speed devices, the particle size distribution (GSD) obtained can be very broad, for example using helical or turbine blades and the like the GSD obtained is generally in the range of 1.80 to 3.22. Although the speed of the agitator can be high, for example 650 rpm using a 10.5 centimeters in length × 3.0 centimeters high turbine blade in a kettle size of 13 centimeters diameter by 17 centimeters high and containing about 900 grams of mixture having a viscosity of about 1,300 centipoise, insufficent shear force is present to effectively break down the large clusters or the mass flocculants of resin and pigment particles resulting in none or very little size reduction. Generally, these ordinary types of agitators create very little shear force and hence their application in step (ii) can lead to undesired particle size and broad GSD upon aggregating the step (iii) components.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle size of 2 to 11 microns and preferably less than about 7 microns, and with narrow geometric size distribution (GSD) of from about 1.16 to about 1.3. Additionally, in some xerographic systems wherein process color is utilized, such as pictorial color applications, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° C. to about 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns and with higher pigment loading such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color and especially in pictorial color, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners of from about 3 to about 5 microns and fixing thereafter results in a low gloss toner image of from about 1 to about 30 gloss units as measured by the Gardner Gloss metering unit. Alternatively, if higher image gloss is desired, such as from about above 30 to about 60 gloss units as measured by the Gardner Gloss metering unit, higher gloss paper is utilized, such as from about above 30 to about 60 gloss units, and which after image formation with small particle size toners of the present invention of from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns such that the pile height of the toner layer(s) is considered low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In these processes, it is usually necessary to subject the aforementioned toners to a classification procedure to obtain a toner geometric size distribution of from about 1.2 to about 1.4. Also, in the aforementioned conventional process, low toner yields after classifications may be obtained. Generally, during the preparation of toner with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of, for example, from about 3 microns to about 9, and preferably 5 microns are attained without resorting to classification processes, and wherein narrow geometric size distributions are obtained, such as from about 1.16 to about 1.30, and preferably from about 1.16 to about 1.25. High toner yields are also attained, such as from about 90 percent to about 98 percent, in embodiments. In addition, by the toner particle preparation process of the present invention in embodiments, small particle size toners of from about 3 microns to about 7 microns can be economically prepared in high yields such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group. The process of the present invention need not utilize polymer polar acid groups, and toners can be prepared with resins such as poly(styrene-butadiene) or PLIOTONE TM containing no polar acid groups. Additionally, the process of the '127 patent does not appear to utilize counterionic surfactant and flocculation process as does the present invention, and does not use a counterionic surfactant for dispersing the pigment. In U.S. Pat. No. 4,983,488, there is illustrated a process for the preparation of toner by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Furthermore, the '488 patent does not disclose the process of counterionic, for example obtaining controlled aggregation by changing the counterionic strength, flocculation as the present invention. The aforementioned disadvantages of, for example, poor GSD are obtained, hence classification is required resulting in low yields, are illustrated in other prior art, such as U.S. Pat. No. 4,797,339, wherein there is disclosed a process for the preparation of toner by resin emulsion polymerization, wherein similar to the '127 patent polar resins of opposite charges are selected, and wherein flocculation as in the present invention is not disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including the effective preparation of small toner particles with narrow particle size distribution; yields of toner are high; large amounts of power consumption are avoided; the process can be completed in rapid times, therefore, rendering it attractive and economical; and it is a controllable process since the particle size of the toner can be tightly controlled by, for example, controlling the temperature of the aggregation, and the desired particle size distribution can be obtained by controlling the shear, speed and time of the blending.

In U.S. Pat. No. 5,290,654 (D/92277), the disclosure of which is totally incorporated herein by reference, there is illustrated a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,020 (D/92097), the disclosure of which is totally incorporated herein by reference, a process for the preparation of in situ toners comprising an halogenization procedure which, for example, chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron, nonionic and counterionic surfactant, thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter, and which exhibit, for example, low fixing temperature of from about 125° C. to about 150° C., low paper curling, and image to paper gloss matching.

In U.S. Pat No. 5,308,734 (D/92576), the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application U.S. Ser. No. 022,575 (D/92577), the disclosure of which is totally incorporated herein by reference there is disclosed a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles above the resin Tg to form said toner composition comprised of polymeric resin, pigment and optionally a charge control agent.

There are believed to be a number of process improvements of the present invention including, for example, the process equipment, namely the IKA SD41 (laboratory unit), IKA Dispax Reactor and the Megatrons, which continuously recirculate the pigment mixture with a latex mixture comprised of a polymer resin, anionic surfactant and nonionic surfactant thus ensuring that the mixture is evenly blended, homogeneous, or uniform as opposed to batch type of devices, for example a Brinkmann (PT/G35M) or IKA (G45M) polytron dispersing tools where the mixing or the blending occurs locally around the polytron dispersing tool resulting, especially at high viscosities, about 2,000 to 3,000 centipoise in a cottage cheese like blend. This behavior is further amplified and noticeable when (a) the solids content is increased from 11 percent to 15 percent in step (ii), and (b) the counterionic concentration to the ionic surfactant is increased from about 1:1 molar ratio to about 2:1 molar ratio for batch type of shearing devices.

In copending patent application U.S. Ser. No. 083,146 (D/93106), filed concurrently herewith, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In copending patent application U.S. Ser. No. 083,157 (D/93107), filed concurrently herewith, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50 and about 80° C., the statically bound aggregated particles to form said toner composition comprised of resin, pigment and optional charge control agent.

In copending patent application U.S. Ser. No. 082,741 (D/93108), filed concurrently herewith, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii)(b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 082,660 (D/93110), filed concurrently herewith, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Ser. No. 083,116 (D/93111), filed concurrently herewith, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process, comprised of (i) preparing a cationic pigment mixture, containing pigment particles, and optional charge control agents and other known optional additives dispersed in water containing a cationic surfactant by shearing, microfluidizing or ultrasonifying; (ii) shearing the pigment mixture with a positively charged latex mixture comprised of a polymer resin, anionic surfactant and nonionic surfactant thereby causing a flocculation or heterocoagulation; (iii) stirring with optional heating at from about 5° C. to about 25° C. below the resin Tg, which resin Tg is preferably equal to 54° C. and is in the range of about 40° C. to about 80° C. and preferably between 50° C. and 75° C., allowing the formation of electrostatically stable aggregates of from about 0.5 to about 5 microns in average volume diameter as measured by the Coulter Counter; (iv) adding about 0.5 to about 5 weight percent of anionic or nonionic surfactant to the aggregates to increase their stability and to retain particle size and particle size distribution during the heating stage; and (v) coalescing or fusing the aggregate particle mixture by heat to toner composites, or a toner composition comprised of resin, pigment, and charge additive.

In a further object of the present invention there is provided a process for the preparation of toner with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

Moreover, in a further object of the present invention there is provided a process for the preparation of toner which after fixing to paper substrates result in images with gloss of from about 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, with pigment particles dispersed in water and surfactant, and wherein the aggregated particles, of toner size, can then be caused to coalesce by, for example, heating. In embodiments, factors of importance with respect to controlling particle size and GSD include the concentration of the surfactant in the latex, concentration of the counterionic surfactant used for flocculation, the need for high shear devices, the temperature of aggregation, the solids content, the time and the amount of the surfactant used for freezing or retaining the particle size to form the toner composite comprising resin, pigment and optional charge additive, or other known toner additives. The particle sizes obtained are generally in the range of from about 3 about 8 microns and the GSD is from about 1.18 to about 1.26

These and other objects of the present invention are accomplished in embodiments by the provision of toners and processes thereof. In embodiments of the present invention, there are provided processes for the economical direct preparation of toner compositions by an improved and controlled flocculation or heterocoagulation, and coalescence, and wherein the amount of cationic surfactant selected can be utilized to control the final toner particle size, that is average volume diameter and wherein a homogeneous blend is formed as indicated herein.

In embodiments, the present invention is directed to processes for the preparation of toner compositions which comprises initially attaining or generating an ionic, anionic or cationic pigment dispersion, for example, by dispersing an aqueous mixture of a pigment or pigments, such as phthalocyanine, quinacridone or RHODAMINE B TM type with a cationic surfactant, such as benzalkonium chloride, by utilizing a high shearing device, such as a Brinkmann Polytron, a sonicator, a microfluidizer IKA SD41, or a Dispax-Reactor as illustrated herein, thereafter shearing this mixture by utilizing a high speed, high shearing device, such as a IKA SD41 or Dispax-Reactor, with a suspended resin mixture comprised of polymer particles, such as poly(styrene, butadiene) or poly(styrene butylacrylate), and of particle size ranging from 0.01 to about 0.5 micron, in an aqueous surfactant mixture containing an anionic surfactant, such as sodium dodecylbenzene sulfonate and nonionic surfactant; resulting in homogeneous blend or flocculation of the resin particles with the pigment particles caused, it is believed, by the neutralization of anionic surfactant absorbed on the resin particles with the oppositely charged cationic surfactant absorbed on the pigment particle; and further stirring the mixture using a mechanical stirrer at 500 rpm, and wherein generally the stirring range is from about 200 to about 1,000 rpm and preferably between 300 to 700 rpm with optional heating, about 5° C. to about 25° C. below the resin Tg, which resin Tg is preferably equal to 54° C. and in general is in the range of about 40° C. about 80° C. and preferably in the range of 50° C. to 75° C., and allowing the formation of electrostatically stabilized aggregates ranging in size of from about 0.5 micron to about 10 microns; followed by the addition of anionic or nonionic surfactant about 0.02 percent to about 5 percent by weight of water, to "freeze" or retain the size of the aggregates, and heating from about 60° C. to about 95° C. to provide for particle fusion or coalescence of the polymer, or resin and pigment particles; followed by washing with, for example, hot water to remove surfactants; and drying, such as by the use of an Aeromatic fluid bed dryer, freeze dryer, or spray dryer; whereby toner comprised of resin and pigment with various particle size diameters can be obtained, such as from about 1 to about 10 microns in average volume particle diameter as measured by the Coulter Counter.

Embodiments of the present invention include a process for the preparation of toner compositions comprising:

(i) preparing a negatively or positively charged pigment dispersion in water, which dispersion is comprised of a pigment in an ionic surfactant;

(ii) shearing at high speeds the pigment dispersion with a polymeric latex comprised of resin of submicron size in the range of from about 0.5 to about 1 micron, a counterionic surfactant with a charge polarity, positive or negative, of opposite sign to that of said ionic surfactant and a nonionic surfactant thereby resulting in a uniform homogeneous blend of flocks with particles of less than or equal to from about 0.5 to about 1 micron in average volume diameter, and which particles are comprised of resin and pigment;

(iii) heating the above sheared homogeneous blend below, from about 5° C. to about 25° C., the glass transition temperature (Tg) of the resin and wherein the Tg of the resin is in range of from about 40° C. to about 85° C. and preferably in range of from about 50° C. to about 75° C., while continuously stirring at from about 200 to about 1,000 revolutions per minute (rpm) and preferably from about 300 to about 700 revolutions per minute to form electrostatically bounded or attached toner size aggregates with a narrow particle size distribution; and (iv) heating at about 5° C. to 50° C. (at temperatures of 60° C. to 105° C.) the statically bound aggregated particles above about the Tg, which Tg is generally in range of 40° C. to 85° C. and preferably in range of 50° C. to 75° C., to provide coalesced particles of toner comprised of polymeric resin, pigment, and optionally a charge control agent;

a process for the preparation of toner with controlled particle size comprising:

(i) preparing a pigment dispersion in water, which dispersion is comprised of a pigment of a diameter of from about 0.01 to about 1 micron, and an ionic surfactant;

(ii) shearing at high speeds the pigment dispersion with preferably a positively charged latex blend comprised of resin of submicron size of from about 0.01 to about 1 micron, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids of resin, pigment and optional charge additive in the water, and surfactant system of anionic/nonionic/cationic;

(iii) heating the above sheared blend at a temperature of from about 5° C. to about 25° C. below the Tg of the resin, which resin Tg is generally in the range of 40° C. to 80° C. and preferably between 50° C. to 75° C., while continuously stirring to form electrostatically bound relatively stable (for Coulter Counter measurements) toner size aggregates with a narrow particle size distribution;

(iv) heating the statically bound aggregated particles at a temperature of from about 5° C. to about 50° C. above the Tg of the resin, which resin Tg is generally in the range of 40° C. to 80° C. and preferably between 50° C. to 75° C., to provide a mechanically stable toner composition comprised of polymeric resin, pigment, and optionally a charge control agent;

(v) separating the formed toner from the water blend by known means like filtration; and (vi) drying the toner; and a process for the preparation of toner compositions with controlled particle size comprising:

(i) preparing a pigment dispersion in water, which dispersion is comprised of a pigment and an ionic surfactant;

(ii) shearing at high speeds of about 3,000 to about 15,000 rpm the pigment dispersion with a latex blend comprised of resin particles, a counterionic surfactant with a charge polarity of opposite sign to that of said ionic surfactant and a nonionic surfactant thereby causing a flocculation or heterocoagulation of the formed particles of pigment, and resin to form a uniform dispersion of solids in water and surfactants;

(iii) heating the above sheared blend below about the glass transition temperature (Tg) of the resin particles while continuously stirring to form electrostatically bounded toner size aggregates with a narrow particle size distribution; and (iv) heating the statically bound aggregated particles above about the Tg, which Tg is in range of from about 40° C. to about 80° C. and preferably from 50° C. to 75° C., to provide a toner composition comprised of polymeric resin and pigment.

In embodiments of the present invention, and the inventions of the copending patent applications filed concurrently, below the Tg can include equal to the Tg or slightly above, and above the Tg can include equal to the Tg or slightly lower.

Embodiments of the present invention include a process for the preparation of toner compositions with preselected sizes, such as from about 1 to about 25 microns in volume average diameter comprising (i) preparing a pigment dispersion in a water, which dispersion is comprised of a pigment, an ionic surfactant, and optionally a charge control agent;

(ii) shearing at high speeds like 5,000 to 30,000 rpm the pigment dispersion with a latex mixture comprised of a counterionic surfactant with a charge polarity of opposite sign to that of said ionic surfactant, a nonionic surfactant and resin particles to achieve a homogeneous or uniform blend of flocks comprising resin particles, pigment particles, and optional charge control agent, water, and the above surfactant mixtures;

(iii) stirring preferably at 500 rpm, and generally stirring in the range of from about 200 to about 1,000 rpm and preferably in the range of 300 to 700 rpm, for about 1 to 4 hours the homogenized mixture with optional heating at a temperature of from about 25° C. to about 50° C., but below (5° C. to 25° C.) the resin Tg (the resin Tg is preferably equal to 54° C., and in the range between 45° C. to 90° C. and preferably between 50° C. and about 80° C.), thereby causing a flocculation or heterocoagulation of the formed particles of pigment, resin and charge control agent to form electrostatically bounded toner size aggregates;

(iv) stabilizing said aggregates by addition of extra 0.5 to 10 percent of the total kettle volume of anionic or nonionic surfactant prior to heating above the resin Tg; and (v) heating to from about 60° C. to about 95° C. the statically bound aggregated particles above, for example 5° C. to about 50° C. above the resin Tg, which resin Tg (glass transition) is in the range of between about 50° C. to about 80° C. and preferably between about 50° C. to about 75° C., to form a toner composition comprised of polymeric resin, pigment, and optionally a charge control agent.

Also, in embodiments the present invention is directed to processes for the preparation of toner compositions which comprises (i) preparing an ionic pigment mixture by dispersing a pigment such as carbon black, like REGAL 330®, HOSTAPERM PINK TM, or PV FAST BLUE TM of from about 2 to about 10 percent by weight of toner in an aqueous mixture containing a cationic surfactant, such as dialkylbenzene dialkylammonium chloride like SANIZOL B-50 TM available from Kao, or MIRAPOL TM available from Alkaril Chemicals, of from about 0.5 to about 2 percent by weight of water utilizing a high shearing device, such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin or polymer particles comprised of, for example, poly(styrene-butylmethacrylate), PLIOTONE TM or poly(styrene-butadiene) of from about 88 percent to about 98 percent by weight of the toner, and of about 0.1 micron to about 3 microns polymer particle size in volume average diameter, and counterionic surfactant, such as an anionic surfactant such as sodium dodecyl sulfate, dodecylbenzene sulfonate or NEOGEN R TM, from about 0.5 to about 2 percent by weight of water, a nonionic surfactant, such polyethylene glycol or polyoxyethylene glycol nonyl phenyl ether or IGEPAL 897 TM obtained from GAF Chemical Company, of from about 0.5 to about 3 percent by weight of water, thereby causing a mass flocculation or heterocoagulation of pigment, charge control additive and resin particles; homogenizing or shearing the resultant mass flocculants with a high shearing device such as a IKA SD41 or IKA Dispax-Reactor, Brinkmann Polytron or IKA homogenizer, in embodiments for low, 200 to 800 centipoise viscosity mixtures, at a speed of from about 3,000 revolutions per minute to about 15,000 revolutions per minute (rpm) and preferably from about 5,000 to 12,000 rpm for a duration of from about 1 minute to about 120 minutes, thereby resulting in a homogeneous mixture of latex and pigment; (iii) stirring the resulting mixture with a mechanical stirrer at a speed of from about 250 to 500 rpm with heating to 5° C. to 25° C. below the resin Tg of preferably 54° C. for 1 to 24 hours to form electrostatically stable aggregates of from about 0.5 micron to about 7 microns in average volume diameter; (iv) adding extra anionic surfactant or nonionic surfactant in the amount of from 0.5 percent to 5 percent by weight of the water to stabilize aggregates formed in the previous step; (v) heating the statically bound aggregate composite particles of from about 60° C. to about 95° C. (5° C. to 50° C. above the resin Tg) and for a duration of about 60 minutes to about 600 minutes to form toner sized particles of from about 3 microns to about 7 microns in volume average diameter and with a geometric size distribution of from about 1.18 to about 1.26 as measured by the Coulter Counter; and (vi) isolating the toner sized particles by washing, filtering and drying, thereby providing a composite toner composition. Additives to improve flow characteristics and charge additives to improve charging characteristics and other known toner additives may then optionally be adding by blending with the toner, such additives including AEROSILS ® or silicas, metal oxides like tin, titanium and the like, from about 0.1 to about 10 percent by weight of the toner.

One preferred method of obtaining a pigment dispersion can depend on the form of the pigment utilized. In some instances, pigments are available in the wet cake or concentrated form containing water, and can be easily dispersed utilizing an homogenizer or stirring. In other instances, pigments are available in a dry form, whereby a dispersion in water is effected by microfluidizing using, for example, a M-110 microfluidizer, and passing the pigment dispersion from 1 to 10 times through the chamber of the fluidizer, or by sonification, such as using a Branson 700 sonicator, with the optional addition of dispersing agents, such as the aforementioned ionic or nonionic surfactants.

Illustrative examples of resin or polymer selected for the process of the present invention include known polymers such as poly(styrenebutadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), poly(butylacrylate-isoprene), poly(styrene-butadiene-acrylic acid), poly(styrene-butadiene-methacrylic acid), PLIOTONE TM available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE TM (Reichhold Chemical Inc), PLASTHALL TM (Rohm & Hass), CYGAL TM (American Cyanamide), ARMCO TM (Armco Composites), CELANEX TM (Celanese Eng), RYNITE TM (DuPont), STYPOL TM The resins selected, which generally can be in embodiments, styrene acrylates, styrene butadienes, styrene methacrylates, or polyesters, are present in various effective amounts, such as from about 85 weight percent to about 98 weight percent of the toner, and can be of small average particle size such as from about 0.01 micron to about 1 micron in average volume diameter as measured by the Brookhaven nanosize particle analyzer.

The resin selected for the process of the present invention is preferably prepared from emulsion polymerization techniques, and the monomers utilized in such processes can be. for example, styrene, acrylates, methacrylates, butadiene, isoprene, and optionally acid or basic olefinic monomers such as acrylic acid, methacrylic acid, acrylamide, methacrylamide, quaternary ammonium halides of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, such as dodecanethiol or carbontetrabromide, can also be selected when preparing the resin particles by emulsion polymerization. Other processes for obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654 (D/92277), the disclosure of which is totally incorporated herein by reference. Mechanical grinding process and other known processes can also be utilized.

Various known colorants or pigments present in the toner in an effective amount of, for example, from about 1 to about 25 percent by weight of the toner, and preferably in an amount of from about 1 to about 15 weight percent, that can be selected include carbon black like REGAL 330 ®, REGAL 330R ®, REGAL 660 ®, REGAL 660R ®, REGAL 400 ®, REGAL 400R ®, and other equivalent black pigments. As colored pigments, there can be selected known cyan, magenta, and yellow components. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E. D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, blue, green, blown, yellow pigments, or mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments or dyes selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum complexes, which additives can also be selected for the concurrently filed copending application, and the like.

Surfactants in amounts of, for example, 0.1 to about 25 weight percent in embodiments include, for example, nonionic surfactants such a, dialkyl-phenoxypoly(ethyleneoxy) ethanol available from Rhone-Poulenac as IGEPAL CA-210 TM, IGEPAL CA-520 TM, IGEPAL CA 720 TM, IGEPAL CO-890 TM, IGEPAL CO-210 TM, ANTAROX 890 TM and the like. An effective concentration of surfactant is preferably in embodiments, for example from about 0.01 to about 10 percent by weight, and preferably from about 0.1 to about 5 percent by weight of monomers used to prepare the copolymer resin.

Examples of ionic surfactants include anionic and cationic surfactants, and wherein examples of anionic surfactants selected for the toners and the processes of the present invention are, for example, sodium dodecyl sulfate (SDS), sodium dodecylbenzene sulfonate, sodium dodecyl naphthalene sulfate, dialkyl benzene alkyl, sulfates and sulfonates, abitic acid available from Aldrich, NEOGEN R TM, NEOGEN SC TM from Kao, and the like. An effective concentration of the anionic surfactant generally employed is, for example, from about 0.01 to about 10 percent by weight, and preferably from about 0.1 to about 5 percent by weight of monomers used to prepare the copolymer resin.

Examples of cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$, trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.1 percent to about 5 percent by weight, of water. Preferably, the molar ratio of the cationic surfactant used for flocculation to the anionic surfactant used in the latex preparation is in the range of about 0.5 to about 4, and preferably from about 0.5 to about 2.

Examples of the surfactant, which are added to the aggregated particles to "freeze" or retain particle size and GSD achieved in the aggregation, can be selected from anionic surfactants, such as sodium dodecylbenzene sulfonate, sodium dodecyl naphthalene sulfate, dialkyl benzene alkyl, sulfates and sulfonates, available from Aldrich, NEOGEN R TM, NEOGEN SC TM from Kao, and the like. This surfactant can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM An effective concentration of the anionic or nonionic surfactant generally employed as a "freezing agent" or stabilizing agent is, for example, from about 0.01 to about 30 percent by weight, and preferably from about 0.5 to about 5 percent by weight, of the total weight of the aggregated mixture, and wherein the whipped cream uniform blend allows for the achievement of narrow desirable GSD.

Surface additives that can be added to the toner compositions after, for example, washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent, which additives can, for example, be added during the aggregation process or blended into the formed toner product.

Developer compositions can be prepared by mixing the toners obtained with the processes of the present invention with known carrier particles, including coated carriers, such as steel, iron, ferrites, and the like, reference U.S. Pat. Nos. 4,937,166 and 4,935,326, the disclosures of which are totally incorporated herein by reference, for example from about 2 percent toner concentration to about 8 percent toner concentration. Imaging methods involve the development of a latent xerographic image on a photoconductive imaging member, reference for example U.S. Pat. No. 4,265,660, the disclosure of which is totally incorporated herein by reference, with the toner obtained by the processes of the present invention; transfer to a suitable substrate, such as paper; and fixing thereto by, for example, heat.

The following Examples are being submitted to further define various species of the present invention. These Examples are intended to be illustrative only and are not intended to limit the scope of the present invention. Also, parts and percentages are by weight unless otherwise indicated.

EXAMPLE I

Aggregation of Styrene/Butylacrylate/Acrylic Acid Latex with Cyan Pigment

Pigment dispersion: 7 grams of dry pigment SUN FAST BLUE TM and 1.46 grams of cationic surfactant SANIZOL B-50 TM were dispersed in 200 grams of water at 4,000 rpm using a blender.

A polymeric latex was prepared by the emulsion polymerization of styrene/butylacrylate/acrylic acid (82/18/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether-nonionic surfactant (ANTAROX 897 TM—70 percent active component), and 4 grams of ammonium persulfate initiator were dissolved. The emulsion was then polymerized at 70° C. for 8 hours. The resulting latex contained 60 percent of water and 40 percent of solids of primarily polystyrene/polybutyacrylate/polyacrylic acid 82/18/2 resin; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—11.7 Percent of Solids Comprising the Above Resin Particles (95 Percent) and Pigment Particles (5 Percent) and Sheared)

Preparation of the aggregated particles: 208.5 grams of the above prepared SUN FAST BLUE TM dispersion were added to 300 milliliters of water containing 1.5 grams of cationic surfactant alkylbenzyldimethyl ammonium chloride (SANIZOL B-50 TM). This dispersion was then simultaneously added with 325 grams of the above prepared latex into SD41 continuous stirring device (Janke & Kunkel IKA Labortechnik) containing 300 grams of water. The pigment dispersion and the latex were well mixed by the continuous pumping through the shearing chamber operating at a high speed of 10,000 rpm for 8 minutes. A homogeneous blend was obtained which was then transferred into a kettle placed in a heating mantle, and equipped with mechanical stirrer and temperature probe. The temperature in the kettle was then raised from room temperature to 45° C. where the aggregation was performed for 2 hours, while stirring at 400 rpm. Aggregates with a particle size (average volume diameter) of 4.7 and GSD of 1.20 (as measured on the Coulter Counter) were obtained. There was an improvement in the GSD by using the high shear device like SD41 to provide a homogeneous blend (Examples I, II, III, IV) as compared to using ordinary agitators at high speeds (Examples IA, IIA, IIIA, IVA).

Coalescence of aggregated particles: after the above aggregation, 55 milliliters of 20 percent anionic surfactant (NEOGEN R TM) were added and the stirring speed was reduced from 400 rpm to 150 rpm. The temperature in the kettle was raised from 45° C. to 85° C. at 1° C./minute. Aggregates of latex and pigment particles were coalesced at 85° C. for 4 hours. After 30 minutes of heating at 85° C., a toner particle size of 4.7 microns average volume diameter, and a GSD of 1.20 was obtained as measured on the Coulter Counter. After 4 hours of heating, toner particles of 4.6 microns (average volume diameter throughout) with a 1.21 GSD were obtained indicating that both the particle size and GSD were retained during the coalescence step. The resulting toner was comprised of poly(styrene-co-butylacrylate-co-acrylic acid), 95 percent, and cyan pigment, 5 percent by weight of toner. The toner particles were then washed by filtration using hot water (50° C.) and dried on a freeze dryer. The yield of dry toner particles was 95 percent.

COMPARATIVE EXAMPLE IA

Aggregation of Styrene/Butylacrylate/Acrylic Acid Latex with Cyan Pigment

Pigment dispersion: 7 grams of dry pigment SUN FAST BLUE TM and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether-nonionic surfactant (ANTAROX 897 TM—70 percent active), and 4 grams of ammonium persulfate initiator were dissolved. The resulting emulsion was then polymerized at 70° C. for 8 hours. The resulting latex contained 60 percent of water and 40 percent of solids comprising poly(styrene/butylacrylate/acrylic acid) resin; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers. The aforementioned latex can be selected for the toner preparation of Example I, IA, II, IIA, III, IIIA, IV and IVA.

Preparation of Toner Size Particles—11.7 Percent of Solids Comprising the Above Resin Particles (95 Percent) and Pigment Particles (5 Percent) and Not Sheared Preparation of the aggregated particles: 208.5 grams of the SUN FAST BLUE TM dispersion were added to 300 milliliters of water containing 1.5 grams of cationic surfactant alkylbenzyldimethyl ammonium chloride (SANIZOL B-50 TM). This mixture was then simultaneously added with 325 grams of the above prepared latex into a kettle containing 300 grams of water while being stirred at 350 rpm. The stirring speed was then increased to 650 rpm as the viscosity increased (from about 2 centipoise to 2,000 to 3,000 centipoise) resulting from the heterocoagulation of the latex and the pigment dispersion. The temperature of the kettle was then raised from room temperature to 45° C. where the aggregation was performed for 3 hours, while stirring at 600 rpm. There were formed aggregates with a particle size of 4.2 and a GSD of 1.92 (as measured on the Coulter Counter). The poor GSD obtained indicates that although a 650 rpm stirring speed was used during the aggregation process not enough shear or no shear force was produced in the blending stage, resulting in big clusters or flocks.

Coalescence of aggregated particles: after aggregation, 55 milliliters of 20 percent (by weight of water) of anionic surfactant (NEOGEN R TM) were added and the speed was reduced from 600 rpm to 150 rpm. The temperature of the kettle was then raised from 45° C. to 85° C. at 1° C./minute. Aggregates of latex and pigment particles were coalesced at 85° C. for 4 hours. A particle size of 4.2 microns average volume diameter with GSD of 1.91 was measured after 30 minutes of heating at 85° C. After 4 hours of heating, toner particles of 4.3 microns with 1.92 GSD were measured on the Coulter Counter, indicating that both the particle size and GSD were retained during the coalescence step. The resulting toner particles were comprised of poly(styrene-co-butylacrylate-co-acrylic acid), 95 percent, and cyan pigment, 5 percent by weight of toner. The toner particles were then washed by filtration using hot water (50° C.) and dried on the freeze dryer.

EXAMPLE II

Aggregation of Styrene/Butylacrylate/Acrylic Acid Resin Latex with Magenta Pigment Pigment dispersion: 7 grams of dry SUN FAST RED TM pigment and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active component), and 4 grams of ammonium persulfate initiator were dissolved. The emulsion was then polymerized at 70° C. for 8 hours. The resulting latex contained 40 percent of solids; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—14 Percent of Solids Comprising the Above Resin Particles (95 Percent) and Pigment Particles (5 Percent) and Sheared Preparation of the aggregated particles: 208.5 grams of the SUN FAST RED TM dispersion were added to 200 milliliters of water containing 1.5 grams of cationic surfactant alkylbenzyldimethyl ammonium chloride (SANIZOL B-50 TM). This was then simultaneously added with 325 grams of the above latex into the SD41 continuous stirring device (Janke & Kunkel IKA Labortechnik) containing 200 grams of water. The pigment dispersion and the latex were well mixed by the continuous pumping through the shearing chamber operating at a high shearing speed of 10,000 rpm for 8 minutes. A homogeneous blend comprising resin of styrene/butylacrylate/acrylic acid, and pigment particles was obtained. This blend was than transferred into a kettle equipped with mechanical stirrer and temperature probe, and placed in the heating mantle. The temperature of the kettle was then raised from room temperature to 45° C. where the aggregation was performed for 3 hours, while stirring at 400 rpm (stirring range is between 250 and 1,000 rpm and preferably in the range of 350 to 700 rpm). Aggregates with a particle size of 3.9 and a GSD of 1.20 (as measured on the Coulter Counter) were obtained.

Coalescence of aggregated particles: after aggregation, 55 milliliters of 20 percent anionic surfactant (NEOGEN R TM) were added and the stirring speed was reduced from 400 rpm to 150 rpm. The temperature in the kettle was raised from 45° C. to 85° C. at 1° C./minutes. Aggregates of latex and pigment particles were coalesced at 85° C. for 4 hours. After 30 minutes of heating at 85° C., a particle size of 4.0 microns with a GSD of 1.20 were obtained as measured on the Coulter Counter. After 4 hours of heating, toner particles of a size of 3.9 microns and a 1.21 GSD were obtained indicating that both the particle size and GSD were retained during the coalescence step. The resulting toner was comprised of poly(styrene-co-butylacrylate-co-acrylic acid), 95 percent, and magenta pigment, 5 percent by weight of toner. The toner particles were then washed by filtration using hot water (50° C.) and dried on the freeze dryer. The yield of dry toner particles was 95 percent.

COMPARATIVE EXAMPLE IIA

Aggregation of Styrene/Butylacrylate/Acrylic Acid Latex with Cyan Pigment

Pigment dispersion: 7 grams of dry pigment SUN FAST RED TM and 1.46 grams of cationic surfactant SANIZOL B-50 were dispersed in 200 grams of water at 4,000 rpm using a blender.

A polymeric latex was prepared by the emulsion polymerization of styrene/butylacrylate/acrylic acid (82/18/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent of active component), and 4 grams of ammonium persulfate initiator were dissolved. The emulsion was then polymerized at 70° C. for 8 hours. The resulting latex contained 40 percent of solids of styrene/butylacrylate/acrylic acid resin; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—14 Percent of Solids Comprising the Above Resin Particles (95 Percent) and Pigment Particles (5 Percent) and Not Sheared Preparation of the aggregated particles: 208.5 grams of the SUN FAST RED TM dispersion were added to 200 milliliters of water containing 1.5 grams of cationic surfactant alkylbenzyldimethyl ammonium chloride (SANIZOL B-50 TM). This was then simultaneously added with 325 grams of latex into a kettle containing 200 grams of water while being stirred at 350 rpm. The stirring speed was then increased to 700 rpm as the viscosity increased (from 2 centipoise to 2,000 to 3,000 centipoise) resulting from the heterocoagulation of the latex and the pigment dispersion. The temperature of the kettle was then raised from room temperature to 45° C. where the aggregation was performed for 3 hours, while stirring at 600 rpm. Aggregates with a particle size of 3.7 and a GSD of 3.54 (as measured on the Coulter Counter) were obtained.

Coalescence of aggregated particles: after aggregation, 55 milliliters of 20 percent anionic surfactant (NEOGEN R TM) were added and the speed reduced from 600 rpm to 150 rpm. The temperature of the kettle was then raised from 45° C. to 85° C. at 1° C./minutes. Aggregates of latex and pigment particles were coalesced at 85° C. for 4 hours. A toner particle size of 3.9 microns with a GSD of 3.52 was measured after 30 minutes of heating at 85° C. After 4 hours of heating, toner particles of 3.8 microns and a 3.51 GSD were measured on the Coulter Counter indicating that both the particle size and GSD were retained during the coalescence step. The resulting toner was comprised of poly(styrene-co-butylacrylate-co-acrylic acid), 95 percent, and magenta pigment, 5 percent by weight of toner. The toner particles were then washed by filtration using hot water (50° C.) and dried on a freeze dryer. The yield of dry toner particles was 95 percent.

EXAMPLE III

Aggregation of Styrene/Butylacrylate/Acrylic Acid Resin Latex with Cyan Pigment

Pigment dispersion: 7 grams of dry pigment SUN FAST BLUE TM and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent of solids; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—15 Percent Solids Comprising the Above Resin Particles (95 Percent) and Pigment Particles (5 Percent) and Sheared Preparation of the aggregated particles: 208.5 grams of the SUN FAST BLUE TM dispersion were added to 150 milliliters of water containing 1.5 grams of cationic surfactant alkylbenzyldimethyl ammonium chloride (SANIZOL B-50 TM). This was then simultaneously added with 325 grams of the above latex into the SD41 continuous stirring device (Janke & Kunkel IKA Labortechnik) containing 200 grams of water. The pigment dispersion and the latex were well mixed by the continuous pumping through the shearing chamber operating at 10,000 rpm for 8 minutes. A homogeneous blend comprising resin and pigment particles was obtained. This blend was then transferred into a kettle placed in the heating mantle and equipped with mechanical stirrer and temperature probe. The temperature in the kettle was then raised from room temperature to 45° C. where the aggregation was performed for 3 hours, while stirring at 400 rpm (stirring range is between 250 and 1,000 rpm and preferably in the range of 350 to 700 rpm). Aggregates with a particle size of 3.5 and a GSD of 1.22 (as measured on the Coulter Counter) were obtained.

Coalescence of aggregated particles: after aggregation, 50 milliliters of 20 percent anionic surfactant (NEOGEN R TM) were added and the stirring speed reduced from 400 rpm to 150 rpm. The temperature in the kettle was raised from 45° to 85° C. at 1° C./minutes. Aggregates of latex and pigment particles were coalesced at 85° C. for 4 hours. After 30 minutes of heating at 85° C., the toner particle size was 3.6 microns with a GSD of 1.21 measured on the Coulter Counter. After 4 hours of heating toner particles of 3.5 microns size and a 1.21 GSD were obtained indicating that both the particle size and GSD were retained during the coalescence step.

The resulting toner particles were comprised of poly(styrene-co-butylacrylate-co-acrylic acid), 95 percent, and cyan pigment, 5 percent by weight of toner. The toner particles were then washed by filtration using hot water (50° C.) and dried on the freeze dryer. The yield of dry toner particles was 95 percent.

COMPARATIVE EXAMPLE IIIA

Aggregation of Styrene/Butylacrylate/Acrylic Acid Latex with Cyan Pigment

Pigment dispersion: 7 grams of dry pigment SUN FAST BLUE TM and 1.46 grams of cationic surfactant SANIZOL B-50 TM were dispersed in 200 grams of water at 4,000 rpm using a polytron.

A polymeric latex was prepared by the emulsion polymerization of styrene/butylacrylate/acrylic acid (82/18/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent solids; the Tg of the latex dry sample was 53.1° C., as measured on DuPont DSC; $M_w$=23,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—15 Percent of Solids Comprising the Above Resin (95 Percent) and Pigment Particles (5 Percent) and Not Sheared Preparation of the aggregated particles: 208.5 grams of the SUN FAST BLUE TM dispersion were added to 150 milliliters of water containing 1.5 grams of cationic surfactant alkylbenzyldimethyl ammonium chloride (SANIZOL B-50 TM). This dispersion was then simultaneously added with 325 grams of the above latex into a kettle containing 200 grams of water while being stirred at 350 rpm. The stirring speed was then increased to 700 rpm as the viscosity increased (from 2 centipoise to 2,000 to 3,000 centipose) resulting from the hetrocoagulation of the latex and the pigment dispersion. The temperature of the kettle was then raised from room temperature to 45° C. where the aggregation was performed for 3 hours, while stirring at 600 rpm (stirring range is between 250 and 1,000 rpm and preferably in the range of 350 to 800 rpm). Aggregates with a particle size of 3.7 and a GSD of 3.24 (as measured on the Coulter Counter) were obtained.

Coalescence of aggregated particles: after aggregation, 55 milliliters of 20 percent anionic surfactant (NEOGEN R TM) were added and the stirring speed was reduced from 700 rpm to 150 rpm. The temperature of the kettle was then raised from 45° C. to 85° C. at 1° C./minutes. Aggregates of latex and pigment particles were coalesced at 85° C. for 4 hours. A particle size of 3.7 microns with GSD of 3.22 was measured after 30 minutes of heating at 85° C. After 4 hours of heating, toner particles of 3.9 microns with a 3.21 GSD were measured on the Coulter Counter indicating that both the particle size and GSD were retained during the coalescence step. The resulting toner particles were comprised of poly(styrene-co-butyl acrylate-co-acrylic acid), 95 percent, and cyan pigment, 5 percent by weight of toner. The toner particles were then washed by filtration using hot water (50° C.) and dried on a freeze dryer. The yield of dry toner particles was 93 percent.

EXAMPLE IV

Aggregation of Styrene/Butylacrylate/Acrylic Acid Latex with Yellow Pigment

Pigment dispersion: 14.6 grams of dry or 45 grams of wet cake (32.5 percent solids) SUN FAST YELLOW TM pigment and 1.46 grams of cationic surfactant SANIZOL B-50 TM were dispersed in 200 grams of water at 4,000 rpm using a blender.

A polymeric latex was prepared by the emulsion polymerization of styrene/butylacrylate/acrylic acid (82/18/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent of solids; the Tg of the latex dry sample was 53.1° C., as measured on DuPont DSC; $M_w$=20,000, and $M_n$=6,000 as determined on Hewlett Packard GPC. The zeta potential as measured on Pen Kern Inc. Laser Zee Meter was −90 millivolts. The particle size of the latex as measured on Brookhaven BI-90 Particle Nanosizer was 160 nanometers.

Preparation of Toner Size Particles—11.7 Percent of Solids Comprising Polymeric Latex Particles (90 Percent) and Pigment Particles (10 Percent) and Sheared at High Speed Preparation of the aggregated particles: 208.5 grams of the SUN FAST YELLOW TM dispersion were added to 300 milliliters of water containing 1.5 grams of cationic surfactant alkylbenzyldimethyl ammonium chloride (SANIZOL B-50 TM). This was then simultaneously added with 325 grams of the above latex into the SD41 continuous stirring device (Janke & Kunkel IKA Labortechnik) containing 300 grams of water. The pigment dispersion and the latex were well mixed by the continuous pumping through the shearing chamber operating at a high shear speed of 10,000 rpm, in contrast to a low speed of 600 rpm, for 8 minutes. A homogeneous blend comprising resin and pigment particles was obtained. This blend was than transferred into a kettle placed in the heating mantle and equipped with mechanical stirrer and temperature probe. The temperature of the kettle was then raised from room temperature to 45° C. where the aggregation was performed for 3 hours, while stirring at 400 rpm. Aggregates with the particle size of 4.7 and a GSD of 1.22 (as measured on the Coulter Counter) were obtained.

Coalescence of aggregated particles: after aggregation, 55 milliliters of 20 percent anionic surfactant (NEOGEN R TM) were added and and the stirring speed was reduced from 400 rpm to 150 rpm. The temperature in the kettle was raised from 45° C. to 85° C. at 1° C./minutes. Aggregates of latex and pigment particles were coalesced at 85° C. for 4 hours. After 30 minutes of heating at 85° C., a particle size of 4.6 microns with GSD of 1.22 was obtained as measured on the Coulter Counter. After 4 hours of heating, toner particles of 4.7 microns size with 1.23 GSD were obtained indicating that both the particle size and GSD were retained during the coalescence step. The resulting toner particles were comprised of poly(styrene-co-butylacrylate-co-acrylic acid), 90 percent, and yellow pigment, 10 percent by weight of toner. The toner particles were then washed by filtration using hot water (50° C.) and dried on the freeze dryer. The yield of dry toner particles was 95 percent.

COMPARATIVE EXAMPLE IVA

Aggregation of Styrene/Butylacrylate/Acrylic Acid Latex with Yellow Pigment

Pigment dispersion: 14.6 grams of dry or 45 grams of wet cake (32.5 percent solids) SUN FAST YELLOW TM pigment and 1.46 grams of cationic surfactant SANIZOL B-50 TM were dispersed in 200 grams of water at 4,000 rpm using a polytron and then sonified for 2 minutes.

A polymeric latex was prepared by the emulsion polymerization of styrene/butylacrylate/acrylic acid (82/18/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent of solids; the Tg of the latex dry sample was 53.1° C., as measured on DuPont DSC; $M_w$=20,000, and $M_n$=6,000 as determined on Hewlett Packard GPC. The zeta potential as measured on Pen Kem Inc. Laser Zee Meter was −90 millivolts. The particle size of the latex as measured on Brookhaven BI-90 Particle Nanosizer was 160 nanometers.

Preparation of Toner Size Particles—11.7 Percent of Solids Comprising Latex Particles (90 Percent) and Pigment Particles (10 Percent) and Not Sheared Preparation of the aggregated particles: 208.5 grams of the SUN FAST YELLOW TM dispersion were added to 300 milliliters of water containing 1.5 grams of cationic surfactant alkylbenzyldimethyl ammonium chloride (SANIZOL B-50 TM). This dispersion was then simultaneously added with 325 grams of the above latex into a kettle containing 300 grams of water while being stirred at 350 rpm. The stirring speed was then increased to 650 rpm as the viscosity increased, from 2 centipoise to 2,000 to 3,000 centipoise, resulting from the heterocoagulation of the latex and the pigment dispersion. The temperature of the kettle was then raised from room temperature to 45° C. where the aggregation was performed for 3 hours while stirring at 600 rpm. Aggregates with a particle size of 4.5 and a GSD of 1.95 (as measured on the Coulter Counter) were obtained.

Coalescence of aggregated particles: after aggregation, 55 milliliters of 20 percent anionic surfactant (NEOGEN R TM) were added and the speed reduced from 600 rpm to 150 rpm. The temperature of the kettle was then raised from 45° C. to 85° C. at 1° C./minutes. Aggregates of latex and pigment particles were coalesced at 85° C. for 4 hours. The toner particle size of 4.7 microns with a GSD of 1.95 was measured after 30 minutes of heating at 85° C. After 4 hours of heating, toner particles of 4.7 microns in average volume diameter with a 1.96 GSD were measured on the Coulter Counter, indicating that both the particle size and GSD were retained during the coalescence step. The resulting toner particles were comprised of poly(styrene-co-butylacrylate-co-acrylic acid), 90 percent, and yellow pigment, 10 percent by weight of toner. The toner particles were then washed by filtration using hot water (50° C.) and dried on the freeze dryer. The yield of dry toner particles was 96 percent.

The following table summarizes the experimental data for the above the four examples. The table evidences that those mixtures that were sheared at high speeds as opposed to nonshearing have a superior particle size distribution (GSD). The shearing was applied in step (ii) of the process. Also, together with the temperature of the aggregation narrow GSD toner can be obtained.

TABLE 1

| EXAMPLE NO. | PARTICLE SIZE | GSD | CONDITIONS |
|---|---|---|---|
| I | 4.6 | 1.21 | Sheared (11.7% solids) |
| IA | 4.3 | 1.92 | Not Sheared (11.7% solids) |
| II | 3.9 | 1.20 | Sheared (14% solids) |
| IIA | 3.8 | 3.51 | Not Sheared (14% solids) |
| III | 3.5 | 1.21 | Sheared (15% solids) |
| IIIA | 3.9 | 3.21 | Not Sheared (15% solids) |
| IV | 4.7 | 1.23 | Sheared (11.7% solids) |
| IVA | 4.7 | 1.96 | Not Sheared (11.7% solids) |

Solids refers to the resin or polymer like the styrene/butylacrylate/acrylic acid, and size or microns is the average volume diameter unless otherwise specifically indicated.

Other modifications of the present invention will occur to those skilled in the art subsequent to a review of the present application. These modifications, and equivalents thereof are intended to be included within the scope of this invention.

What is claimed is:

1. A process for the preparation of toner compositions with controlled particle size consisting essentially of:

(i) preparing a pigment dispersion in water, which dispersion is comprised of pigment, an ionic surfactant, and an optional charge control agent;

(ii) shearing at high speeds the pigment dispersion with a polymeric latex comprised of resin, a counterionic surfactant with a charge polarity of opposite sign to that of said ionic surfactant and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bounded toner size aggregates with a narrow particle size distribution;

(iv) heating the statically bound aggregated particles above about the Tg of the resin particles to provide coalesced toner comprised of resin, pigment, and optional charge control agent, and subsequently optionally accomplishing (v) and (vi);

(v) separating said toner; and (vi) drying said toner.

2. A process in accordance with claim 1 wherein the homogeneous dispersion of pigment and resin is dispersed in water containing surfactants, and enables a narrow particle size distribution or GSD of aggregates formed in (iii) of from about 1.16 to about 1.26.

3. A process in accordance with claim 1 wherein the homogeneous blend (ii) is achieved by shearing the dispersion of the latex, the pigment and surfactants in water at a speed of from about 3,000 to about 15,000 revolutions per minute.

4. A process in accordance with claim 1 wherein the shearing (ii) of the latex, pigment, and surfactants is achieved with a polytron or a homogenizer.

5. A process in accordance with claim 1 wherein the shearing (ii) of the latex, pigment, and oppositely charged surfactants is achieved by a continuous shearing device with a variable gap adjustment of from about 0.1 to about 3 millimeters.

6. A process in accordance with claim 1 wherein the shearing (ii) of the latex, pigment, and oppositely charged surfactant is achieved at a temperature of from 0° to about 40° C.

7. A process in accordance with claim 1 wherein the homogeneous blend of the latex, pigment, and surfactants is subjected to shearing for from about 2 minutes to about 120 minutes to obtain a narrow particle size distribution of aggregated particles.

8. A process in accordance with claim 1 wherein the time of shearing (ii) controls the homogeneity of the blend of latex particles, pigment, and surfactants.

9. A process in accordance with claim 1 wherein the surfactant utilized in preparing the pigment dispersion is a cationic surfactant, and the counterionic surfactant present in the latex mixture is an anionic surfactant.

10. A process in accordance with claim 1 wherein the surfactant utilized in preparing the pigment dispersion is an anionic surfactant, and the counterionic surfactant present in the latex mixture is a cationic surfactant.

11. A process in accordance with claim 1 wherein the pigment dispersion of (i) is accomplished by homogenizing at from about 1,000 to about 10,000 revolutions per minute and preferably between about 2,000 to about 5,000 revolutions per minute at a temperature of from about 20° C. to about 35° C. for a duration of from about 1 minute to about 120 minutes.

12. A process in accordance with claim 1 wherein the pigment dispersion of (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

13. A process in accordance with claim 1 wherein the dispersion of (i) is accomplished by microfluidization in a microfluidizer or in nanojet for a duration of from about 1 minute to about 120 minutes.

14. A process in accordance with claim 1 wherein the homogenization (ii) is accomplished by homogenizing at from about 1,000 revolutions per minute to about 10,000 revolutions per minute for a duration of from about 1 minute to about 120 minutes.

15. A process in accordance with claim 1 wherein the heating of the blend in (iii) is accomplished at temperatures from about 20° C. to about 5° C. below the Tg of the resin for a duration of from about 0.5 to about 6 hours.

16. A process in accordance with claim 1 wherein the heating of the statically bound aggregate particles to form toner size particles comprised of pigment, resin, and optional charge control agent is accomplished at a temperature of from about 10° C. above the Tg of the resin to about 95° C. above the Tg of the resin for a duration of from about 1 hour to about 8 hours.

17. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

18. A process in accordance with claim 1 wherein the resin is selected from the group consisting of poly(styrene-butadiene-acrylic acid) poly(styrene-butadiene-methacrylic acid) poly(styrene-butyl methacrylate-acrylic acid), poly(styrene-butyl acrylate-acrylic acid), polyethylene-terephthalate, polypropylene-terephthalate, polybutylene-terephthalate, polypentylene-terephthalate, polyhexalene-terephthalate, polyheptadene-terephthalate, poly(styrene-butadiene), and polyoctalene-terephthalate.

19. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and which surfactant is selected in an amount of from 0 to about 5 percent by weight of the mixture.

20. A process in accordance with claim 1 wherein the anionic surfactant is selected from the group consisting of sodium dodecyl sulfate, sodium dodecylbenzene sulfate, sodium dodecylnaphthalene sulfate, sodium lauryl sulfate, sodium alkyl naphthalene sulfonate, and potassium alkyl sulfonate; and which surfactant is selected in an effective concentration of from about 0.01 to about 10 percent and preferably from about 0.02 to about 5 percent by total weight of the aqueous mixture.

21. A process in accordance with claim 1 wherein the cationic surfactant is an alkylbenzalkonium chloride present in the effective concentration of from about 0.01 to about 10 percent and preferably from about 0.02 to about 2 percent by total weight of the mixture.

22. A process in accordance with claim 1 wherein the pigment is carbon black, cyan, yellow, magenta, green, brown, blue, red, or mixtures thereof.

23. A process in accordance with claim 1 wherein the pigment is present in the amount of from about 0.1 to about 10 percent by weight.

24. A process in accordance with claim 1 wherein the pigment is from about 0.01 to about 1 micron in average volume diameter; the resin utilized in (ii) is from about 0.01 to about 3 microns in average volume diameter; the statically bound aggregate particles formed in (iii) are from about 1 to about 10 microns in average volume diameter; and the coalesced particles formed in (iv) are from about 1 to about 20 microns in average volume diameter.

25. A process in accordance with claim 1 wherein the toner isolated is from about 1 to about 20 microns in average volume diameter, and the geometric size distribution thereof is from about 1.15 to about 1.35.

26. A process in accordance with claim 1 wherein the toner is washed with warm water and the surfactants are removed from the toner surface followed by drying.

27. A process in accordance with claim 1 wherein there is added to the surface of the isolated toner additives of metal salts, metal salts of fatty acids, silicas, metal oxides, or mixtures thereof in an amount of from about 0.1 to about 10 weight percent.

28. A process in accordance with claim 1 wherein the speed of shearing (ii) is in the range of from about 4,000 to about 15,000 revolutions per minute and preferably in the range of from about 6,000 to about 12,000 revolutions per minute, thereby controlling the homogeneity of the blend of the latex particles, pigment, and oppositely charged surfactant in water.

29. A process in accordance with claim 1 wherein in (iii) the Tg of the resin is in range of from about 40° C. to about 85° C. and preferably is in the range of from about 50° C. to about 75° C.

30. A process in accordance with claim 1 wherein stirring is accomplished continuously at from about 200 to about 1,000 and preferably between about 300 to about 700 revolutions per minute.

31. A process in accordance with claim 1 wherein the Tg of the resin is 54° C.

32. A process in accordance with claim 1 wherein the statically bound aggregated particles are heated to a temperature of from about 5° C. to about 50° C. above the resin Tg, which resin Tg is from about 40° C. to about 85° C.

33. A process in accordance with claim 3 wherein said speed is from about 6,000 to about 12,000, and the particle size of the formed toner is from about 3 to about 7 microns in average volume diameter.

34. A process for the preparation of toner consisting essentially of:

(i) preparing a pigment dispersion in water, which dispersion is comprised of a pigment and an ionic surfactant;

(ii) shearing at high speeds of from about 3,000 to about 15,000 revolutions per minute the pigment dispersion with a polymeric latex comprised of resin of submicron size in the range of from about 0.5 to about 1 micron, a counterionic surfactant with a charge polarity of opposite sign to that of said ionic surfactant and a nonionic surfactant thereby resulting in a uniform homogeneous blend with particles of less than or equal to from about 0.5 to about 1 micron in average volume diameter, and which particles are comprised of resin and pigment;

(iii) heating the above sheared homogeneous blend below, from about 5° C. to about 25° C., the glass transition temperature (Tg) of the resin and wherein the Tg of the resin is in range of from about 40° C. to about 85° C. and preferably in the range of from about 50° C. to about 75° C., while continuously stirring at from about 200 to about 1,000 revolutions per minute and preferably from about 300 to about 700 revolutions per minute to form electrostatically bound toner size aggregates with a narrow particle size distribution; and (iv) heating the statically bound aggregated particles at from about 5° C. to about 50° C. above the resin Tg to provide coalesced particles of a toner composition comprised of polymeric resin, pigment and, optionally a charge control agent.

35. A process in accordance with claim 34 wherein subsequent to (iv) the following steps are accomplished:

(v) separating said toner particles from water and surfactants; and (vi) drying said toner.

36. A process for the preparation of toner consisting essentially of:

(i) preparing a pigment dispersion, which dispersion is comprised of pigment and ionic surfactant;

(ii) shearing at high speeds of from about 3,000 to about 15,000 revolutions per minute the pigment dispersion with a latex blend comprised of resin, a counterionic surfactant with a charge polarity of opposite sign to that of said ionic surfactant and a nonionic surfactant thereby causing a flocculation or heterocoagulation of the formed particles of pigment and resin to form a uniform viscous dispersion of solids of resin and pigment, from about 5 to about 25 weight percent, in water, and anionic/-nonionic/cationic surfactant system;

(iii) heating the above sheared blend at a temperature of from about 5° to about 25° C. below the Tg of the resin particles while continuously stirring to form electrostatically bound relatively stable, for Coulter Counter measurements, toner size aggregates with a narrow particle size distribution;

(iv) heating the statically bound aggregated particles at a temperature of from about 5° to about 50° C. above the Tg of the resin to provide a mechanically stable toner composition comprised of resin, and pigment; and optionally (v) separating said toner; and (vi) drying said toner.

37. A process for the preparation of toner comprising:

(i) preparing a pigment dispersion, which dispersion is comprised of a pigment and an ionic surfactant;

(ii) shearing at high speeds the pigment dispersion with a latex blend comprised of resin, a nonionic surfactant, and a counterionic surfactant with a charge polarity of opposite sign to that of said ionic surfactant thereby forming a uniform homogeneous dispersion;

(iii) heating the above sheared blend below about, equal to, or slightly higher than the glass transition temperature (Tg) of the resin to form aggregates with a narrow particle size distribution; and (iv) heating the statically bound aggregated particles above, or equal to the Tg of the resin.

38. A process in accordance with claim 3 wherein said speed is from about 3,000 to about 15,000 revolutions per minute in (ii) and there is formed a uniform homogeneous dispersion of flocculated particles of resin and pigment; and in (iii) electrostatically bounded toner size aggregates with a GSD of from about 1.16 to about 1.26 are formed; and there results in (iv) a toner with a volume average diameter of from about 1 to about 10 microns.

39. A process in accordance with claim 1 wherein a freezing agent or stabilizing agent component anionic or nonionic surfactant is added to the formed aggregates of (iii).

40. A process in accordance with claim 1 wherein the shearing (ii) of the latex, pigment, and surfactants is achieved with a continuous on-line homogenizer comprising a 3 stage rotator stator.

* * * * *